United States Patent [19]

Hennuy et al.

[11] Patent Number: 4,669,207

[45] Date of Patent: Jun. 2, 1987

[54] WATER INJECTION DEVICE FOR A STEAM IRON

[75] Inventors: Jean-Pierre Hennuy, Villefranche; Daniel Bontoux, St. Genis Laval, both of France

[73] Assignee: Seb S.A., Selongey, France

[21] Appl. No.: 800,168

[22] Filed: Nov. 20, 1985

[30] Foreign Application Priority Data

Nov. 23, 1984 [FR] France ..... 84 17875

[51] Int. Cl.[4] ..... D06F 75/18

[52] U.S. Cl. ..... 38/77.5; 38/778

[58] Field of Search ..... 38/77.5, 77.83, 77.9, 38/77.8, 77.7; 219/271, 273, 245

[56] References Cited

U.S. PATENT DOCUMENTS

| | | | |
|---|---|---|---|
| 2,746,183 | 5/1956 | Kistner . | |
| 2,887,799 | 5/1959 | Kuhn et al. . | |
| 3,474,552 | 10/1969 | Swenson | 38/77.8 |
| 3,758,969 | 9/1973 | Davidson | 38/77.5 |
| 3,849,916 | 11/1974 | Davidson et al. | 38/77.83 |
| 3,889,406 | 6/1975 | Chivers et al. | 38/77.83 |
| 4,079,528 | 3/1978 | Lindstaedt et al. | 38/77.83 |
| 4,296,560 | 10/1981 | Schwob | 38/77.83 X |

FOREIGN PATENT DOCUMENTS

| | | | |
|---|---|---|---|
| 1931848 | 3/1978 | Fed. Rep. of Germany | 38/77.8 |
| 580713 | 11/1924 | France . | |
| 602293 | 3/1926 | France . | |
| 1316012 | 12/1962 | France . | |
| 2449157 | 9/1980 | France . | |
| 448004 | 3/1968 | Switzerland . | |
| 1366852 | 9/1974 | United Kingdom | 38/77.83 |

*Primary Examiner*—Werner H. Schroeder
*Assistant Examiner*—Andrew M. Falik
*Attorney, Agent, or Firm*—Young & Thompson

[57] ABSTRACT

A water injection device for automatic de-scaling of steam irons comprises an axially displaceable injection plunger (21) which controls the communication between a reservoir (4) and a vaporization chamber (3) according to whether the flexible annular lip (17) of a nozzle (8) surrounds the plunger either in a smooth region (28) or in a laterally recessed region (26). A flexible skirt (19) surrounds the flow passage downstream of the lip (17). The injection plunger (21) terminates in an annular de-scaling boss (31) which is surrounded by the skirt (19) when the plunger is in the closed position.

7 Claims, 5 Drawing Figures

FIG_1
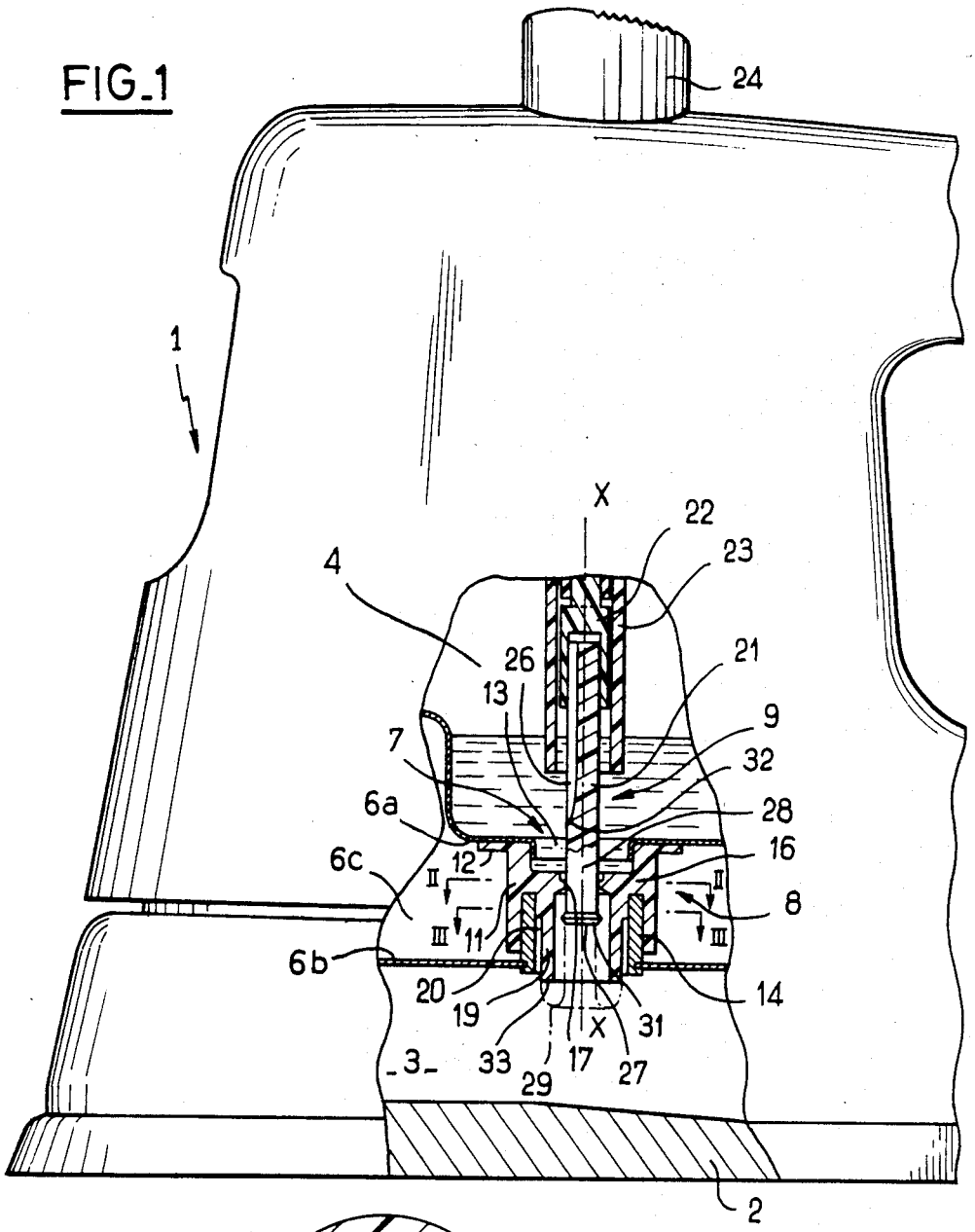
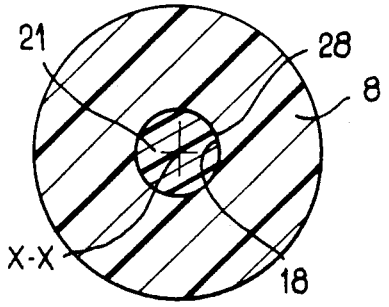
FIG_2
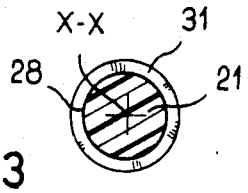
FIG_3

FIG. 4
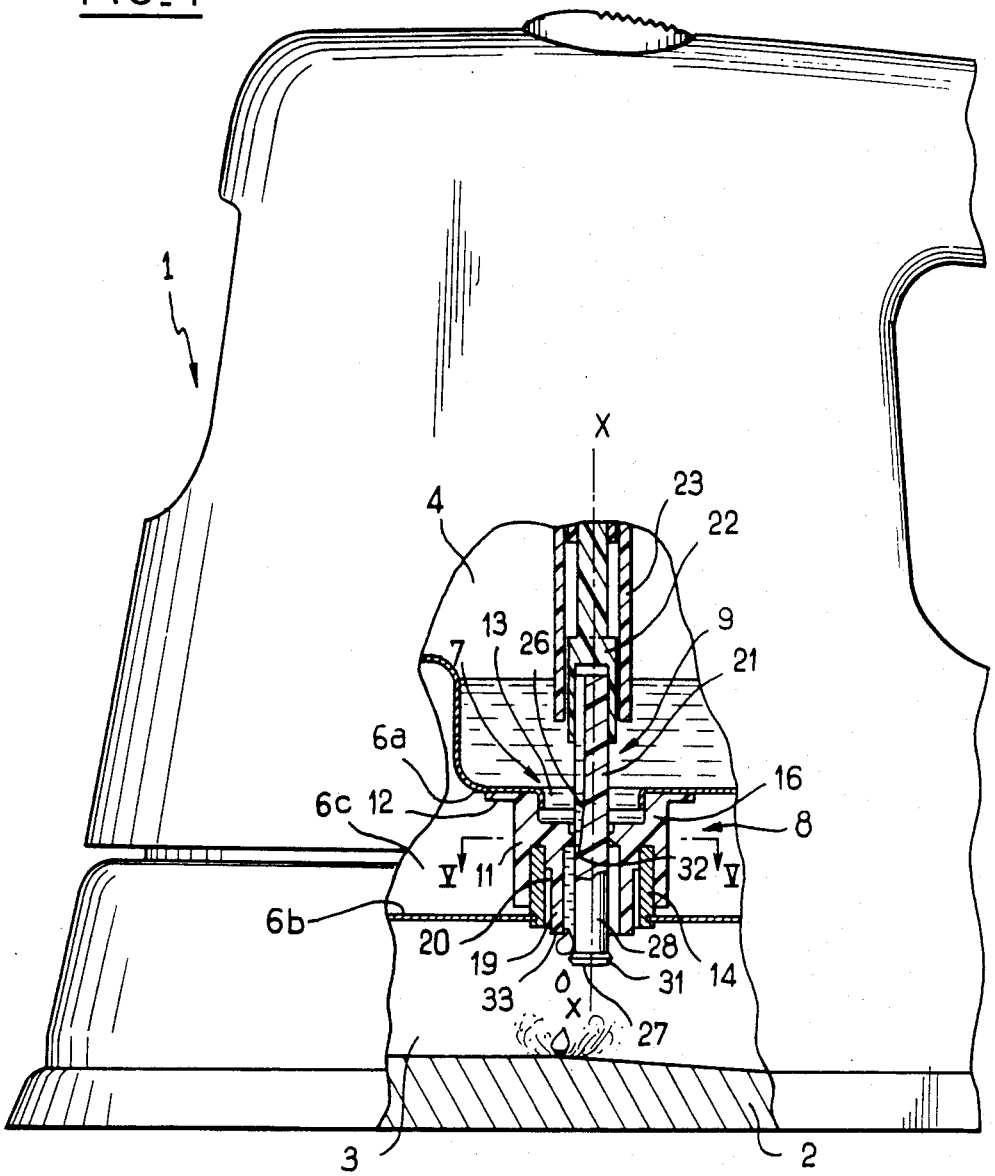
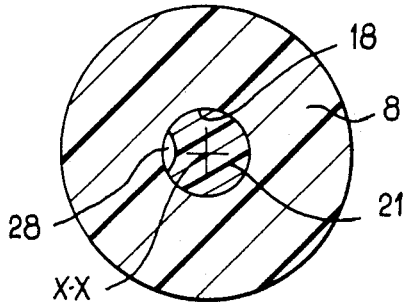
FIG. 5

WATER INJECTION DEVICE FOR A STEAM IRON

BACKGROUND OF THE INVENTION

1. Field of the Invention

The present invention relates to an injection device for a steam iron. This device comprises more particularly a nozzle mounted within an opening in a wall which forms a separation between a water reservoir and a vaporization chamber, said chamber being located beneath the reservoir when the iron is in service. The nozzle has an annular lip which delimits a communication orifice between the reservoir and the chamber. Said nozzle also has a skirt which surrounds the flow passage downstream of the lip with respect to the direction of flow. The device further comprises an injection plunger which is provided with a lateral recess, said plunger being axially displaceable within the orifice between a closed position in which the lip surrounds the plunger between a free end of this latter and the lateral recess, and an injection position in which the lip surrounds the plunger between the two axial ends of said lateral recess.

2. Description of the Prior Art

A known device of this type has already been disclosed in French patent No. FR-A-2,449,157. When the injection plunger moves from one end position to the other, it subjects the lip to flexural deformation and prevents scale formation. Since the smooth region is located beneath the axial recess under operating conditions, the plunger can be moved to the injection position simply by exerting downward pressure, which is a convenient procedure.

This simple construction is nevertheless attended by a disadvantage in that a sheath of scale tends to form beneath the lip around the smooth region of the injection plunger. In such a case, even if the user places the plunger in the injection position, the smooth region of the plunger which is surrounded by and joined to the sheath of scale prevents the water from reaching the vaporization chamber. If the plunger remains in the injection position over a long period of time, it may even be locked in this position as a result of scale formation.

Swiss patent No. CH-A-448,004 discloses an injection device having a nozzle comprising a concave conical seat followed by a calibrated cylindrical orifice at the lower end. A valve which is capable of moving along the axis of the nozzle cooperates with the seat and is adapted to carry in addition a pintle which is engaged within the calibrated orifice when the valve is in the closed position. On the contrary, when the valve is moved away from its seat, the pintle is located above the orifice and the water flows in principle at a rate which is determined by calibration of the orifice. When the valve returns to the closed position, the pintle causes a downward displacement of the scale deposit which may have formed within the orifice and prevents this orifice from subsequently becoming completely incrusted with scale if the device is not actuated for a certain length of time.

In order to overcome the difficulty which may be experienced when operating the valve if the scale forms an adhesive film between the pintle and the orifice, provision is made at the end of the pintle for a spherical bulge or head which is located beyond the orifice when the valve is closed. When the user again opens the valve, the pintle-head is intended to sweep the orifice and thus to produce a de-scaling action. This expedient, however, is not very effective. In point of fact, if the scale has the effect of subjecting the pintle to a braking action, it is difficult if not actually impossible to engage the head within the orifice. Furthermore, if the pintle is jammed within the orifice instead of being simply braked, the pintle-head which is located beyond the orifice cannot produce any action. Supposing finally that the pintle-head performs its function and causes the scale to move upwards to the region of the valve-seat, then either the scale will subsequently impair the leak-tightness of the valve in the closed position or else it will fall back into the orifice and will immediately re-incrust this latter.

SUMMARY OF THE INVENTION

The aim of the invention is thus to propose an injection device of the type mentioned at the outset, in which the sheath of scale which is liable to surround the smooth region of the injection plunger is effectively removed.

In accordance with the invention, the water injection device is distinguished by the fact that the skirt is flexible and that the plunger is provided axially and beyond its smooth region with an annular boss which is surrounded by the skirt in the closed position of the plunger.

By virtue of the flexibility of the skirt, scale can never cause complete jamming of the plunger. If the plunger is moved by hand to its closed position when it is surrounded by a deposit of scale within the skirt, the boss tends to cause displacement of the scale with the plunger. If resistance is encountered, this displacement has the effect of deforming the skirt, thus establishing favorable conditions for fragmentation of the layer of scale and detachment of said layer from the skirt. The fragments of scale then fall and will therefore no longer be liable to engage within the nozzle.

BRIEF DESCRIPTION OF THE DRAWINGS

Other features of the invention will be more apparent to those skilled in the art upon consideration of the following description and accompanying drawings, wherein:

FIG. 1 is a fragmentary view in side elevation showing a laundry iron in accordance with the invention, with an axial cross-section of the water injection device;

FIG. 2 is a view of the injection device in cross-section along the plane II—II of FIG. 1;

FIG. 3 is a view of the injection plunger in cross-section along the plane III—III of FIG. 1;

FIG. 4 is a view which is similar to FIG. 1 but shows the plunger in the injection position;

FIG. 5 is a view in cross-section along the plane V—V of FIG. 4.

DETAILED DESCRIPTION OF THE INVENTION

In the example which is illustrated in the figures, the laundry iron comprises a casing 1 of plastic material mounted on a heating sole-plate 2. A vaporization chamber 3 is arranged between the top face of the heating sole-plate 2 and a sheet-metal wall **6*b*. The heating sole-plate 2 is traversed by steam distribution ducts (not shown in the drawings) through which the vaporization chamber 3 communicates with the exterior beneath the sole-plate 2**.

The casing 1 contains a water reservoir 4, the bottom sheet-metal wall 6*a* of which is located above the top wall 6*b* of the chamber 3. There is formed between the walls 6*a* and 6*b* a hollow space 6*c*, the function of which is to prevent overheating of the water and formation of steam within the reservoir 4. The walls 6*a* and 6*b* are substantially horizontal in the service position of the iron in which the sole-plate 2 itself is horizontal. An opening 7 extends through the walls 6*a* and 6*b*, the nozzle 8 of a water injection device 9 being mounted within said opening. By means of this injection device, the water contained in the reservoir 4 is selectively fed drop-by-drop into the vaporization chamber 3 under the action of gravity.

The nozzle 8 comprises a tubular body 11 and the annular end portion of said body which is directed towards the reservoir 4 has an annular flange 12 which is applied around the opening 7 and beneath the bottom sheet-metal wall 6*a* which is adjacent to the reservoir 4. The bottom wall 6*a* is in turn provided around the opening 7 with a cylindrical collar 13 which is fitted within the body 11. A metallic tube 14 is crimped at the end nearest the chamber 3 on the circular edge of the plate 6*b* which is adjacent to the chamber 3, namely the edge which surrounds the opening 7. The tube 14 is force-fitted in the body 11 with zero clearance up to an annular wing 16 of the body 11, said wing being directed radially inwards. The body 11 is thus centered by the cylindrical collar 13 and the tube 14 and is positioned axially between said tube 14 and the sheet-metal wall 6*a*.

The wing 16 is provided with a flexible annular lip 17, the free edge of which defines a circular orifice 18 (as shown in FIG. 2). The lip 17 is displaced towards the reservoir 4 relatively to the sheet-metal wall 6*b* in order to be protected as far as possible from the heat generated by the heating sole-plate 2. On that face which is directed towards the vaporization chamber 3, the wind 16 carries within the metallic tube 14 a skirt 19 having a cylindrical internal wall, the diameter of which is larger than the diameter of the orifice 18. Over the greater part of its axial length, the skirt 19 is surrounded by a free space 20 which forms a radial separation between the skirt and the tube 14. The free space 20 extends up to a free end 33 provided on the skirt 19 towards the vaporization chamber 3, and thus communicates with chamber 3 around the skirt 19. The free end 33 projects out of the tube 14 towards the vaporization chamber 3. The body 11, the annular flange 12, the wing 16, the lip 17 and the skirt 19 are formed in a single block of silicone resin.

The injection device 9 further comprises a plunger 21 constituted by a rod having a generally cylindrical shape and formed of heat-resistant plastic material. The rod 21 extends along the axis X—X of the nozzle 8 and in particular of the orifice 18, this axis being perpendicular to the plane of the walls 6*a* and 6*b* and of the heating sole-plate 2. At the end remote from the sole-plate 2, the injection plunger 21 is attached to a push-rod 22 which is slidably mounted along the axis X—X within a sleeve 23. The push-rod 22 is connected to a thumb-control push-button 24 which projects from the top of the casing 1.

The injection plunger 21 is provided in the vicinity of the push-rod 22 with a lateral recess 26 constituted by a groove which is directed parallel to the axis X—X. The cross-sectional area of the groove 26 considered in a plane perpendicular to the axis X—X decreases in the direction of the heating sole-plate 2. This is apparent from the decreasing depth of the groove 26 in FIGS. 1 and 4. The injection plunger 21 has a smooth cylindrical region 28 between its groove 26 and the free end 27 which is directed towards the sole-plate 2. The diameter of the plunger 21 in the region corresponding to the groove 26 and in the region 28 is larger than the diameter of the orifice 18 prior to assembly of the plunger 21 and is smaller than the internal diameter of the skirt 19.

By means of a spring-loaded restoring device (not illustrated in the drawings), the injection plunger 21 continuously tends to return to a closed position (as shown in FIG. 1) in which the lip 17 surrounds the smooth cylindrical region 28 of the plunger 21. In this position, the plunger 21 shuts-off the orifice 18 and consequently prevents any flow of water to the vaporization chamber 3.

By depressing the push-button 24 (shown in FIG. 4), the user can displace the injection plunger 21 along the axis X—X until the lip 17 surrounds said plunger 21 in the region corresponding to the groove 26. From that moment onwards (as shown in FIGS. 4 and 5), the groove 26 permits a calibrated leak through the orifice 18, from the reservoir 4 to the vaporization chamber 3. Taking into account the non-constant cross-section of the groove 26, the rate of flow towards the vaporization chamber 3 is correspondingly higher as the plunger 21 is displaced towards the sole-plate 2 with greater force, which can be controlled by the user by varying the pressure exerted on the push-button 24.

In a device of this type, the flexible lip 17 is subjected to flexural deformation and consequently descaled as a result of the axial movements of the plunger 21. Moreover, thanks to the annular end 33 projecting towards the vaporization chamber 3, water reaching said end 33 falls down in the vaporization chamber 3 instead of creeping towards the tube 14 and forming scale there. Formation of scale is thus reduced. On the other hand, if despite this, a tubular deposit having a cross-sectional shape as shown in chain-dotted outline at 29 in FIG. 1 forms within the skirt 19 and if no arrangements are made to guard against this deposit 29, the plunger 21 is liable to be braked or even locked against any further displacements. Moreover, the scale deposit may form a water-tight seal between the skirt 19 and the plunger 21, thus preventing any flow even when the plunger 21 is in the injection position. In order to overcome this difficulty, consideration could be given to the possibility of placing the lip 17 in the plane of the plate 6*b* but this arrangement would carry a disadvantage in that the lip would be more exposed to heating by the sole-plate 2. Similarly, the plunger 21 would move too close to the sole-plate 2 in the injection position.

In accordance with the invention, the skirt 19 has a thickness in the radial direction which endows it with a certain degree of flexibility, taking into account the material (silicone resin) of which it is made. Furthermore, the plunger 21 is provided at the free end 27 which is directed towards the sole-plate 2 with an annular boss 31 which, when seen in cross-section along a plane which passes through the axis X—X, has the shape of an isosceles triangle, the base of which is parallel to the axis X—X. The external diameter of the boss 31 is smaller than the internal diameter of the skirt 19. Preferably, the boss 31 has an external diameter which enables it to pass through the lip 17 simply by elastic deformation of this latter, thus making it possible to remove the plunger 21 from the top of the iron for cleaning purposes.

When the plunger 21 is in the closed position, the annular boss 31 is surrounded by the skirt 19 (as shown in FIG. 1). Moreover, the distance between the boss 31 and the axial extremity 32 of the groove 26 nearest said boss 31 is greater than or equal to (equal in the example illustrated) the distance between the lip 17 and the annular extremity 33 of the skirt 19 at the downstream end nearest the sole-plate 2. Thus, as soon as the groove 26 engages within the lip 17, the boss 31 passes out of the skirt 19 and therefore does not interfere with the flow along this latter.

Supposing, for example, that the large deposit of scale 29 shown in FIG. 1 has formed within the skirt 19 after a long period of injection and that the user moves the injection plunger 21 back to the closed position. The movement of the boss 31 tends to displace the deposit 29 which has the effect of deforming the skirt 19, thus causing cracking and fragmentation of the scale deposit 29 and detaching this latter from the skirt 19. The fragments detached from the skirt 19 fall onto the sole-plate 2, thus permitting the desired movement of the plunger 21.

The fragments of scale are thus moved permanently away from the injection device.

Numerical examples are given below for certain dimensions of the injection device.

Diameter of the injection plunger 21 : 4 mm
External diameter of the annular boss 31 : 5 mm
Internal diameter of the skirt 19 : 7 mm
Axial dimension of the skirt 19 : 10 mm
Thickness of the skirt 19 : 1.5 mm.

As will readily be apparent, the invention is not limited to the example hereinabove described with reference to the accompanying drawings. On the contrary, many alternative arrangements can be made in this example without thereby departing either from the scope or the spirit of the invention.

From this it accordingly follows that the annular boss can be located at a point short of the free extremity of the plunger and may have a profile which is different from that described and illustrated.

What is claimed is:

1. An injection device for a steam iron, said device comprising a nozzle mounted within an opening of a wall which forms a separation between a water reservoir and a vaporization chamber, said chamber being located beneath the reservoir when the iron is in service, said nozzle comprising an annular lip which delimits a communication orifice between the reservoir and the chamber, and a skirt which surrounds the flow passage downstream of the lip with respect to the direction of flow, the device further comprising an injection plunger which is provided with a lateral recess and is axially displaceable within the orifice between a closed position in which the lip surrounds the plunger in a smooth region between the free end of said plunger and the lateral recess, and an injection position in which the lip surrounds the plunger in the region provided with the lateral recess, wherein the skirt is flexible and wherein the plunger is provided axially beyond the smooth region thereof with an annular boss which is surrounded by said skirt in the closed position of said plunger, said annular boss and said skirt being so dimensioned that when a predetermined thickness of scale has accumulated on the inside of said skirt, the passage of said boss through said skirt will coact with said accumulated scale to expand said skirt outwardly, thereby cracking and removing said accumulated scale, the distance between the annular boss and that axial extremity of the lateral recess which is directed towards said annular boss being at least substantially equal to the distance between the lip and the downstream annular extremity of the skirt.

2. A device according to claim 1, wherein the external diameter of the annular boss (31) is smaller than the internal diameter of the skirt (19).

3. A device according to claim 1, wherein the lip (17) has a sufficient degree of flexibility to allow the annular boss (31) to pass through said lip at the time of removal of the injection plunger (21).

4. A device according to claim 1, wherein the annular boss (31) is located at the free end of the injection plunger (21).

5. A device according to claim 1, wherein the skirt (19) is surrounded by a free space (20) over at least part of its axial length.

6. A device according to claim 5, wherein said free space (20) communicates with the vaporization chamber (3) around the skirt (19).

7. A device according to claim 1, wherein the skirt (19) has a free end (33) which projects towards the vaporization chamber (3), whereby lateral creeping of water from said end is avoided.

* * * * *